US009139968B2

(12) United States Patent
James

(10) Patent No.: US 9,139,968 B2
(45) Date of Patent: Sep. 22, 2015

(54) ENERGY ABSORPTION APPARATUS

(75) Inventor: Dallas Rex James, Auckland (NZ)

(73) Assignee: Valmont Highway Technology Limited, Auckland (NZ)

( * ) Notice: Subject to any disclaimer, the term of this patent is extended or adjusted under 35 U.S.C. 154(b) by 110 days.

(21) Appl. No.: 13/426,027

(22) Filed: Mar. 21, 2012

(65) Prior Publication Data

US 2012/0241702 A1 Sep. 27, 2012

(30) Foreign Application Priority Data

Mar. 22, 2011 (NZ) ..... 591857

(51) Int. Cl.
*E01F 15/04* (2006.01)
*E01F 15/14* (2006.01)

(52) U.S. Cl.
CPC ..... *E01F 15/143* (2013.01); *E01F 15/0423* (2013.01); *Y10T 29/49826* (2015.01)

(58) Field of Classification Search
CPC .... E01F 15/04; E01F 15/0407; E01F 15/0423
USPC ..... 256/13.1
See application file for complete search history.

(56) References Cited

U.S. PATENT DOCUMENTS

| | | | | |
|---|---|---|---|---|
| 7,686,535 | B2 | 3/2010 | Bergendahl et al. | |
| 8,517,349 | B1 * | 8/2013 | Ross et al. | 256/13.1 |
| 2009/0206308 | A1 * | 8/2009 | Amengual Pericas | 256/13.1 |
| 2009/0302288 | A1 | 12/2009 | James | |
| 2010/0207087 | A1 * | 8/2010 | James | 256/13.1 |
| 2011/0084246 | A1 * | 4/2011 | Amengual Pericas | 256/13.1 |

FOREIGN PATENT DOCUMENTS

WO 2005/028757 3/2005

* cited by examiner

*Primary Examiner* — Michael P Ferguson
(74) *Attorney, Agent, or Firm* — Greer, Burns & Crain, Ltd.

(57) ABSTRACT

A guardrail or other energy absorbing apparatus includes a plurality of terminal end rails extending longitudinally extend between a plurality of support posts, wherein a first four of said plurality of rails (labelled 1-4 below) situated at a terminal end of a guardrail, or impact end of an energy absorbing apparatus; are connected to one another at respective downstream and upstream ends via: an impact slider assembly joined to a downstream portion of terminal rail 1, and surrounding a downstream portion of terminal rail 1 and an upstream portion of an adjacent rail 2; a first set of frangible bolts which are the sole bolts connecting rail 2 and adjacent rail 3 together; and a second set of frangible bolts which connect rail 3 and adjacent rail 4 together, wherein at least one standard post bolt connects the rails 3 and 4 to a post at this joint.

4 Claims, 3 Drawing Sheets

ENERGY ABSORPTION APPARATUS

TECHNICAL FIELD

The present specification details an energy absorbing apparatus. In particular the present invention relates to a guardrail.

BACKGROUND ART

The specification details an energy absorbing apparatus which includes one or more longitudinal members. The specification in one embodiment details a guardrail which comprises longitudinal members in the form of rails. For ease of reference, the present invention will now be discussed in relation to a guardrail. Although, it will be appreciated that the present invention may have utility in relation to different energy absorbing applications, utilising telescoping longitudinal members.

Guardrails are widely used throughout the world on the side(s) of highways, motorways and the like to act as a safety barrier to redirect errant vehicles back onto the road. However, the terminal ends of guardrails pose a significant risk to vehicles which have a head on impact therewith. It would therefore be an advantage, if there could be provided a way, in which more of the energy arising from a head on impact with the terminal end of a guardrail, could be absorbed, so as to minimise the damage caused to a vehicle, involved in such a collision.

Current guardrails, marketed as "X-tension" utilise a single set of frangible (shear) bolts to join the second and third rails, and a slider which fits around the first and second rails, at the terminal end of a guardrail, joins the first and second rails together. The slider is bolted to the downstream end of the first rail, and after a head on impact travels along the second rail. When the slider reaches the downstream end of the second rail the upstream end of the second rail impacts with an impact head on the upstream end of the first rail. The shock of this impact with the end of the second rail with the impact head, shears the heads off the shear bolts. As the shear bolts have now failed this disconnects the second and third rails, which can now telescope with respect to one another, as the slider to travels along and gathers the third rail therein, alongside, the first and second rails.

However, once the slider has travelled along the third rail further telescoping with the fourth rail is not possible as a second set of shear bolts cannot be utilised to join the third and fourth rails. As if a second set of shear bolts is used to join the third and fourth rails the applicant has found it is difficult to reliably control the order in which the shear bolts fail. Thus if the downstream second set of shear bolts connecting the third and fourth rails is to fail before the first set of shear bolts upstream this prematurely halts telescoping and energy absorption.

Ideally, it would be desirable if a terminal end of a guardrail could have at least one additional set of shear bolts, connecting downstream rails in a manner that enables more rails to reliably telescope, in sequential order, from upstream to downstream, so as to absorb more energy from a head on impact. However, as mentioned the key is to somehow control when the downstream bolts shear, which is difficult, as the shock of impact automatically transfers force along the rails, and can cause downstream bolts to shear prior to upstream bolts shearing. This, in turn, adversely reduces the capacity of the guardrail to absorb energy.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

It is an object of the present invention to address the foregoing problems or at least to provide the public with a useful choice.

Further aspects and advantages of the present invention will become apparent from the ensuing description which is given by way of example only.

DEFINITIONS

The term 'frangible bolt' as used herein refers to a bolt or other like device which has a construction which is significantly weaker in terms of resisting a transverse force, with respect to the longitudinal axis of the bolt, than a standard bolt (such as is used to securely connect a rail to a post in a guardrail—herein a 'standard post bolt').

SUMMARY

The present invention is concerned with providing a way of allowing more adjacent rails to telescope with respect to one another in a guardrail system to absorb more impact energy. Previously, as mentioned above, only the first three terminal rails can telescope with respect to one another.

According to one aspect of the present invention there is provided a guardrail or other energy absorbing apparatus which includes a plurality of terminal end rails which longitudinally extend between a plurality of support posts wherein the first four rails (herein rails 1-4), situated at a terminal end of a guardrail, or impact end of an energy absorbing apparatus; are connected to one another at respective downstream and upstream ends thereof via:

- an impact slider assembly joined to a downstream portion of terminal rail 1, surrounding a downstream portion of terminal rail 1 and an upstream portion of an adjacent and rail 2;
- a first set of frangible bolts which are the sole bolts connecting rail 2 and adjacent rail 3 together; and
- a second set of frangible bolts which connect rail 3 and adjacent 4 together, wherein at least one standard post bolt connects the rails 3 and 4 to a post at this joint.

A guardrail or other energy absorbing apparatus which has a plurality of terminal end rails as substantially as described above which includes at least one standard post bolt connects a middle portion of each rail to a post.

A method of controlling the telescoping of longitudinal members forming part of a guardrail or other energy absorbing apparatus the method comprising the steps of:

a) connecting the first four rails, situated at a terminal end of guardrail or impact end of an energy absorbing apparatus, to one another at respective downstream and upstream ends thereof via:
   - an impact slider assembly between terminal rail 1 and rail 2;

a first set of frangible bolts which alone connect rails 2 and 3 to one another; and a second set of frangible bolts which connect rails 3 and 4 to one another and at least one post bolt also connecting the rails 3 and 4 to each another and to a post at this joint.

A method substantially as described above wherein there is an additional step of connecting additional rails to the guardrail or other energy absorbing apparatus via sets of frangible bolts and additional post bolts in a similar manner to that employed for the second set of frangible bolts, except every successive downstream joint utilises more post bolts than preceding upstream joints.

A method of joining rails to facilitate absorbing energy and telescoping of rails in a guardrail or other energy absorbing apparatus comprising a step of progressively increasing the relative joint strength for respective downstream joints connecting adjacent rails to one another starting from a first joint downstream of an impact slider assembly in order to control the order in which the subsequently downstream joints fail, following an impact and during telescoping movement of the rails.

The advantage provided by this arrangement of frangible bolts and bolts is that it ensures upstream sets of frangible bolts always break before the subsequent sets of frangible bolts when there is an end collision with the terminal end of the guardrail. This ensures the slider assembly can gather and retain telescoping rails in a sequential order during a head on collision with guardrail.

BRIEF DESCRIPTION OF DRAWINGS

Further aspects of the present invention will become apparent from the following description which is given by way of example only and with reference to the accompanying drawings in which.

DETAILED DESCRIPTION

Figure 1:
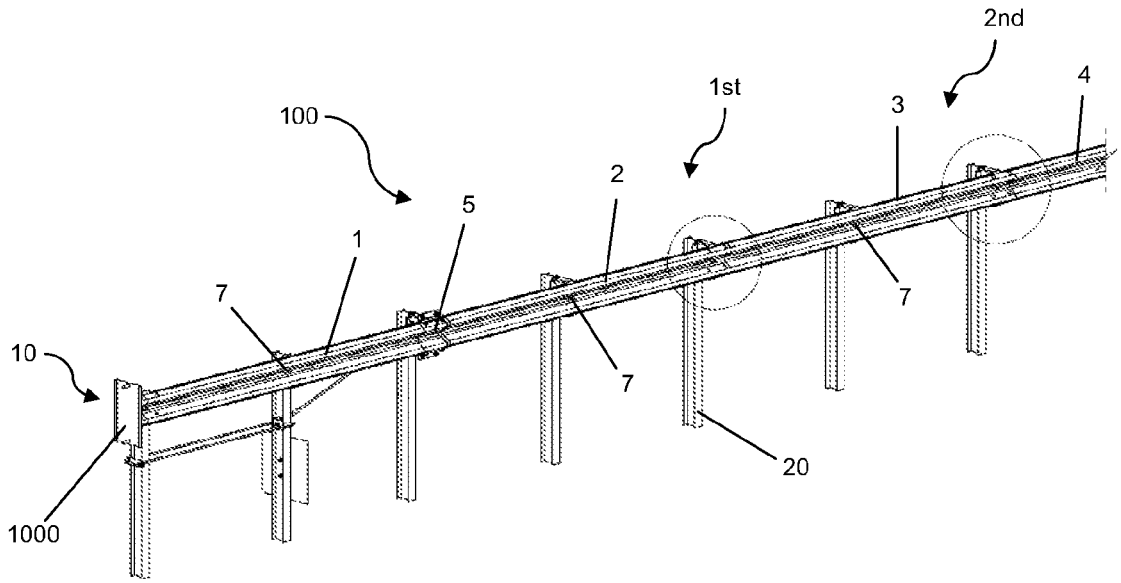
FIG. 1 is an end on perspective view of a guardrail in accordance with one preferred embodiment of the present invention.

With respect to FIG. 1 there is provided a guardrail 100 which has a terminal end 10 and associated impact head 1000, support posts 20 and rails 1, 2, 3 and 4. Standard post bolts 7 hold the midpoint of rails 1, 2 and 3 to support posts 20 as shown.

Figure 2:
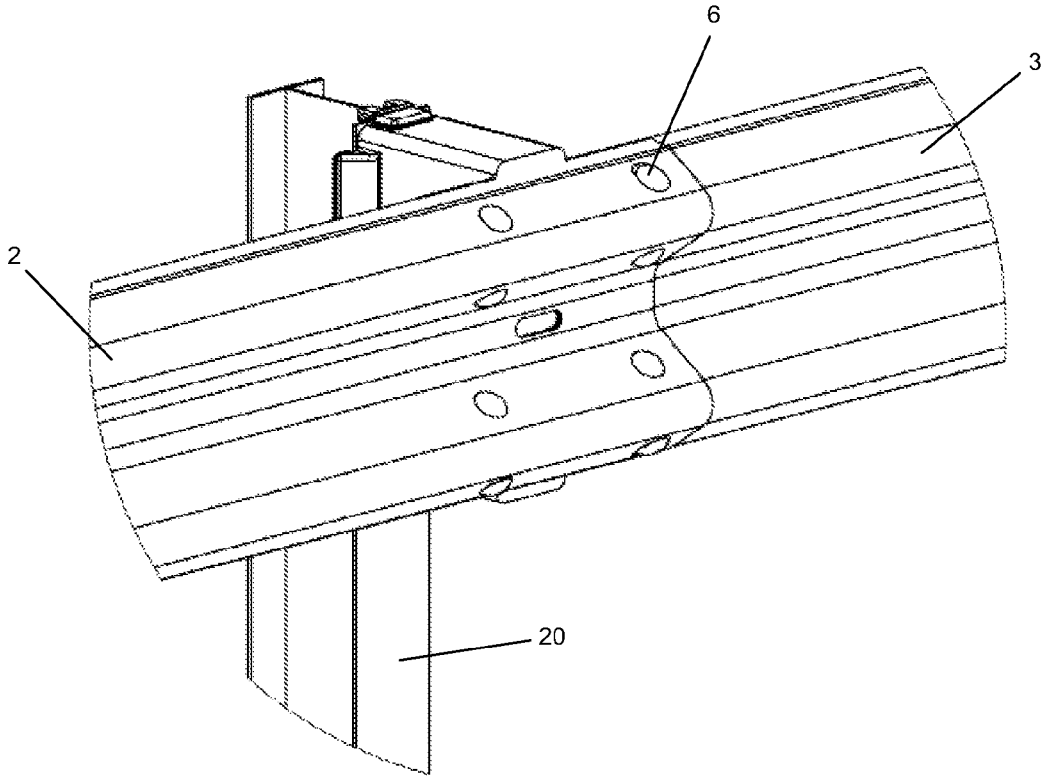
FIG. 2 shows a close up perspective of connection point A as shown in FIG. 1 using shear bolts.
Figure 3:
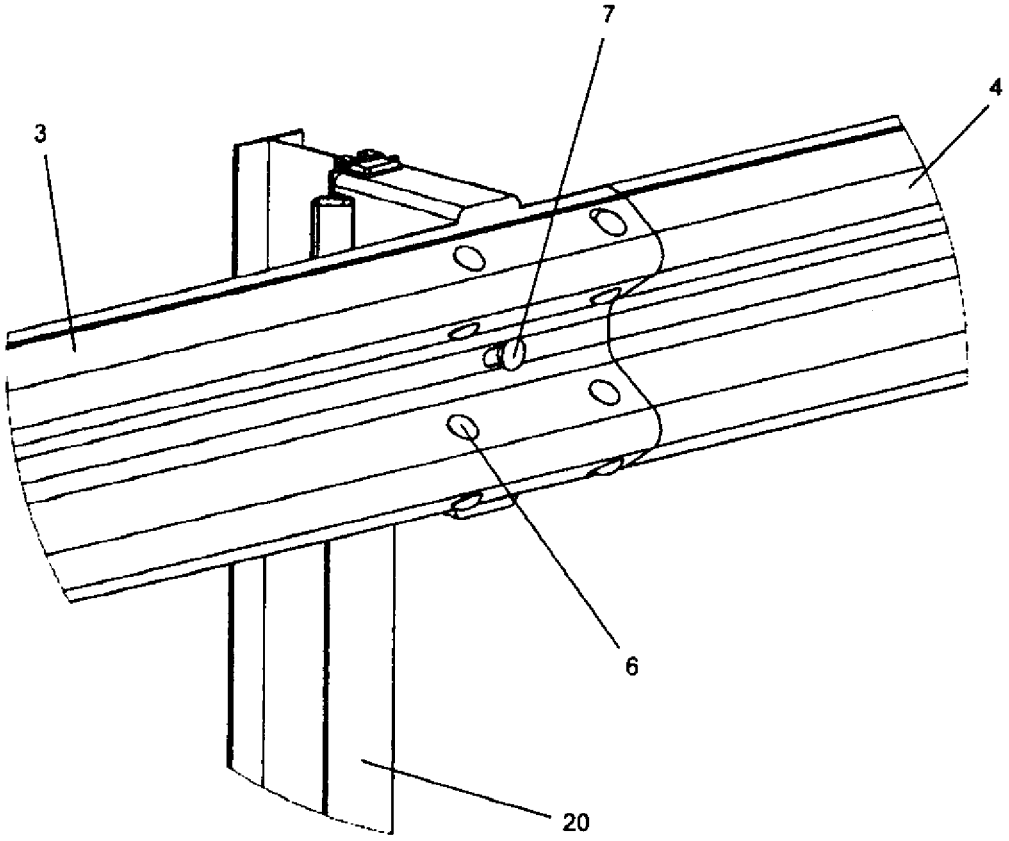
FIG. 3 shows a close up perspective of connection point B shown in FIG. 1 using shear bolts and a post bolt.

The rails 1 and 2 are connected to one another via a slider 5 which surrounds these rails and generally confirms to the cross section profile of the rails. As shown in FIG. 2, rails 2 and 3 are connected solely via a set of eight frangible bolts in the form of shear bolts 6 (the first set). Rails 3 and 4 as shown in FIG. 3 are connected via a further set of eight shear bolts 6 together with a standard post bolt 7 (the second set). The standard post bolt 7 in FIG. 3 holds the rails to the support post 20 and increases the relative strength of this connection joint between rails 3 and 4 compared to the first set of shear bolts shown in FIG. 2 joining rails 2 and 3 which also do not include a standard post bolt and are therefore not connected to post 20.

As noted in the above background art discussion the inventor had previously found it critical to only have one set of shear bolts (the first set—shown by the arrow marked $1^{st}$) connecting rails 2 and 3 as it was found if other sets of shear bolts were used to connect downstream rails such as rails 3 and 4 (the second set—shown by the arrow marked $2^{nd}$) it was impossible to control the order in which the sets of shear bolts would fail. In some instances the $1^{st}$ and $2^{nd}$ set could fail simultaneously, or the $2^{nd}$ set could fail before the first set, typically both mis-events being triggered as the impact head 1000 on the downstream end of the first rail (rail 1) impacted with the upstream end of the second rail (rail 2). However, with the guardrail configured as shown in FIG. 1 the order in which the sets of shear bolts fail is controlled so the $1^{st}$ set fails before the $2^{nd}$ set. The $2^{nd}$ set failing when the impact head 1000 impacts with the upstream end of the third rail (rail 3) during telescoping of the rails. The impact head 1000 impacting with the upstream end of the rails can also trigger additional upstream joints to fail sequentially depending on the force to be absorbed and length of rails.

Thus, given these difficulties with controlling with certainty the sequential order in which the sets of shear bolts need to fail resulted in prior art guardrails only having one set of shear bolts being employed.

The present invention as shown in FIG. 1 has now overcome this problem and allows a greater amount of controlled telescoping to occur and enables more energy to be absorbed during head on impact situations.

Figure 4:
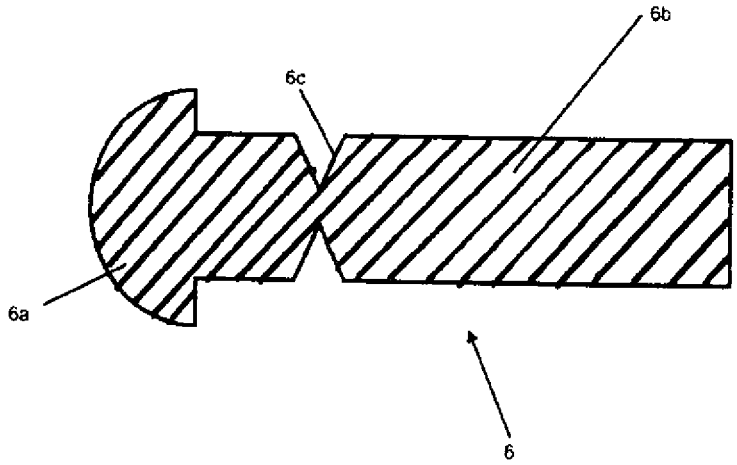
FIG. 4 shows a shear bolt as employed in the guardrail of FIG. 1.
Figure 5:
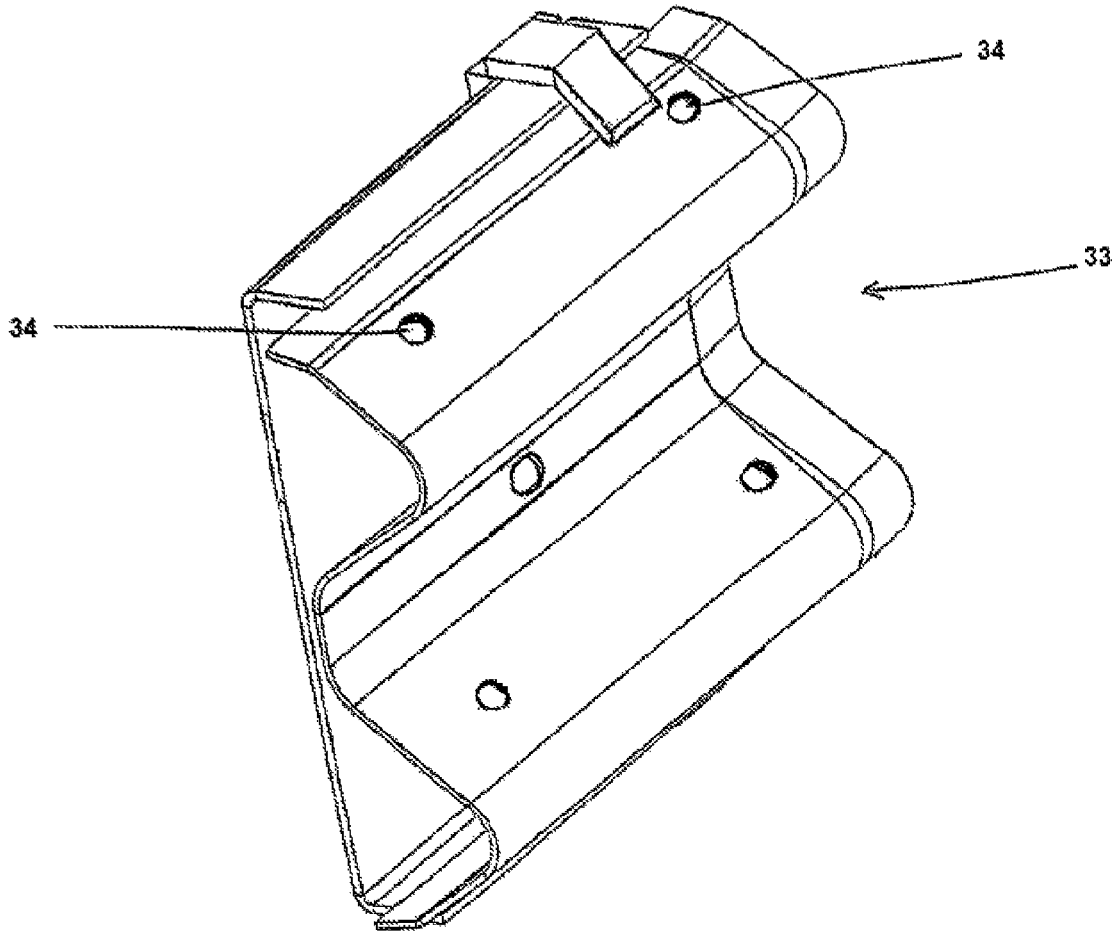
Figure 5 PRIOR ART
FIG. 5 shows a perspective view of a prior art impact slider assembly that can be employed with the present invention.

In FIG. 4 there is shown a shear bolt 6 which is around 35 mm in length and which has a head 6*a* and a shaft 6*b*. A v-shaped notch 6*c* circumscribes the shaft 6*b* adjacent where it joins the head 6*a*. By way of comparison a standard post bolt is around 240-250 mm in length depending on whether it is screwed into the support block 200 shown in FIG. 1 or whether it passes through the support block 200 to effectively connect the rails to the support post 20 via engaging a nut.

DETAILED DISCUSSION OF ALTERNATIVE WAYS TO IMPLEMENT THE INVENTION

The frangible bolts can come in a variety of different forms.

In some embodiments the frangible bolts may be rivet bolts having a weaker construction than a standard metal post bolt used on a guardrail for attaching the rail to the post.

In some preferred embodiments the frangible bolt may be in the form of a shear bolt. For example a bolt which has been adapted to break at a reduced load in comparison to a standard metal splice bolt.

In some preferred embodiments the shear bolts may include a notch which radially circumscribe at least a portion of said bolt proximate a head thereon to create a region of weakness.

In other preferred embodiments the frangible bolt may be made of plastics or some other material which is structurally weaker than the material and/or construction of the slider.

Typically the frangible bolts may be around 32-35 mm in length.

The standard post bolts may be any bolt suitable for holding the rails of a guardrail or such like to a support post. In preferred embodiments the standard post bolt may be made of metal and around 240-250 mm in length.

The standard post bolts may have tapered shafts for screwing into wooden support blocks or may simply be threaded for connecting to a support post via a nut or threaded aperture in the post.

In some further embodiments the rails may be joined by spot welding or via other connecting methods, products, devices or mechanisms which may or may not also include bolt type devices. In one such embodiment where spot welding is employed less welds may be used for each upstream joints between rails, so the order in which the joints fail, and telescoping commences, can be controlled so as to occur in a sequential manner: each time the impact head strikes the upstream end of another rail, following telescoping along a preceding rail.

Aspects of the present invention as detailed herein have been described by way of example only and it should be appreciated that modifications and additions may be made thereto without departing from the scope of the appended claims.

What I claim is:

1. A guardrail which includes a plurality of terminal end rails which longitudinally extend between a plurality of support posts wherein a first four rails of the plurality of rails, situated at a terminal end of a guardrail connected to an impact head, are telescopically connected to one another at respective downstream and upstream ends thereof, the guardrail comprising:

an impact slider joined to a downstream portion of a terminal rail, the impact slider surrounding the downstream portion of the terminal rail and an upstream portion of an adjacent second rail and being laterally supported by a first support post;

a first set of frangible shear bolts which are the sole bolts connecting a downstream portion of the second rail and an upstream portion of an adjacent third rail together, the second and third rails being laterally supported by a second support post without being bolted thereto; and a second set of frangible shear bolts which connect a downstream portion of the third rail and an upstream portion of an adjacent fourth rail together, wherein at least one standard post bolt connects the third and fourth rails to a third support post, wherein said standard post bolt increases the relative strength of the connection of the third and fourth rails compared to the connection of the second and third rails;

wherein when the impact head is impacted by a vehicle, the impact slider allows the terminal rail and second rail to telescope relative to each other, and subsequently the first set of frangible shear bolts fail before the second set of frangible shear bolts such that the second and third rails telescope relative to one another prior to telescoping of the third and fourth rails.

2. The guardrail which has a plurality of terminal end rails as claimed in claim 1, wherein at least one standard post bolt connects a middle portion of each rail to a support post.

3. The guardrail which has a plurality of terminal end rails as claimed in claim 1, wherein the shear bolts include a notch which radially circumscribes at least a portion of each said bolt proximate a head thereon to create a region of weakness.

4. A method of controlling the telescoping of a guardrail which includes a plurality of terminal end rails which longitudinally extend between a plurality of support posts, the method comprising the steps of:

telescopically connecting a first four rails of the plurality of rails, situated at a terminal end of a guardrail connected to an impact head, to one another at respective downstream and upstream ends thereof via:

an impact slider between a terminal rail and an adjacent second rail, the impact slider surrounding a downstream portion of the terminal rail and an upstream portion of the second rail and being laterally supported by a first support post;

a first set of frangible shear bolts which alone connect a downstream portion of the second rail and an upstream portion of an adjacent third rail to one another, the second and third rails being laterally supported by a second support post without being bolted thereto; and a second set of frangible shear bolts which connect a downstream portion of the third rail and an upstream portion of an adjacent fourth rail to one another and at least one standard post bolt also connecting the third and fourth rails to each other and to a third support post, wherein said standard post bolt increases the relative strength of the connection of the third and fourth rails compared to the connection of the second and third rails:

wherein when the impact head is impacted by a vehicle, the impact slider allows the terminal rail and second rail to telescope relative to each other, and subsequently the first set of frangible shear bolts fail before the second set of frangible shear bolts such that the second and third rails telescope relative to one another prior to telescoping of the third and fourth rails.

* * * * *